US006561853B1

(12) United States Patent
Yu

(10) Patent No.: US 6,561,853 B1
(45) Date of Patent: May 13, 2003

(54) ELECTRICAL CONNECTOR ASSEMBLY

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/135,813

(22) Filed: Apr. 29, 2002

(30) Foreign Application Priority Data

Dec. 26, 2001 (KR) ..... 90223003

(51) Int. Cl.[7] ..... H01R 17/00
(52) U.S. Cl. ..... 439/660; 439/31; 439/79
(58) Field of Search ..... 439/660, 31, 79, 439/862, 65, 286, 288, 292

(56) References Cited

U.S. PATENT DOCUMENTS 4,657,320 A * 4/1987 Bamford et al. ..... 439/31
4,715,819 A * 12/1987 Iwasa et al. ..... 439/31
4,863,388 A * 9/1989 Reimer et al. ..... 439/31
4,877,409 A * 10/1989 Tanigawa et al. ..... 439/31

* cited by examiner

*Primary Examiner*—Hien Vu
(74) *Attorney, Agent, or Firm*—Wei Te Chung

(57) ABSTRACT

An electrical connector assembly includes a first electrical connector (2) and a second electrical connector (3). Each of the first and the second electrical connector has an insulative housing (22), (32) and a number of electrical contacts (21), (31). Each insulative housing has a base portion (221), (321) and a number of tongues (222), (322) extending laterally from the base portion and spaced from each other along a longitudinal direction of the base portion. Each electrical contact (21), (31) includes a mounting portion (212), (312) extending beyond the base portion and a contact portion (211), (311) extending from the mounting portion and exposed to the tongue. The tongues of the second electrical connector extend between the tongues of the first electrical connector and the contact portions of the electrical contacts of first and the second electrical connectors electrically contact with each other, respectively.

2 Claims, 5 Drawing Sheets

ELECTRICAL CONNECTOR ASSEMBLY

BACKGROUND OF THE INVENTION

1. Field of the Invention

The present invention relates to an electrical connector assembly, and particularly to a board to board electrical connector assembly.

2. Description of the Related Art

A board to board electrical connector assembly, as is known to persons of ordinary skill in the pertinent art, usually comprises a first electrical connector mounted on a first printed circuit board and a second electrical connector mounted to a second printed circuit board and matable with the first electrical connector to establish an electrical connection between the first and the second printed circuit boards. In some instances, the first and the second printed circuit boards need to be assembled to each other in a rotatable manner, that is, although the first and the second printed circuit boards are parallel to each other when the first and the second electrical connectors are completely mated with each other, in the course of mating, the first and the second electrical connectors, and therefore the first and the second printed circuit boards, define an angle therebetween.

However, most of the present board to board electrical connector assemblies are configured in such a way that the first and the second electrical connectors can only mate with each other in a manner of being always parallel to each other, since insulative housings of the first and the second electrical connectors interference with each other if there is an angle defined therebetween.

Therefore, an improved electrical connector assembly is desired to match the above-mentioned needs.

SUMMARY OF THE INVENTION

A major object of the present invention is to provide a board-to-board electrical connector assembly, which comprises a first and a second electrical connectors respectively mounted to a first and a second printed circuit boards to rotatably assemble the first printed circuit board and the second printed circuit board.

An electrical connector assembly in accordance with the present invention comprises a first electrical connector mounted to a first printed circuit board and a second electrical connector mounted to a second printed circuit board. Each of the first and the second electrical connectors comprises an insulative housing and a plurality of electrical contacts. Each insulative housing comprises a base portion and a plurality of tongues extending from the base portion. The tongues extend parallely along a lateral direction of the base portion and are spaced from each other in a longitudinal direction of the base portion. Each electrical contact comprises a mounting portion extending beyond the base portion and a contact portion extending from the mounting portion through the base portion and exposed to the tongue. The tongues of the first electrical connector extend into between the tongues of the second electrical connector and the contact portions of the electrical contacts of the first and the second electrical connectors electrically contact with each other, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
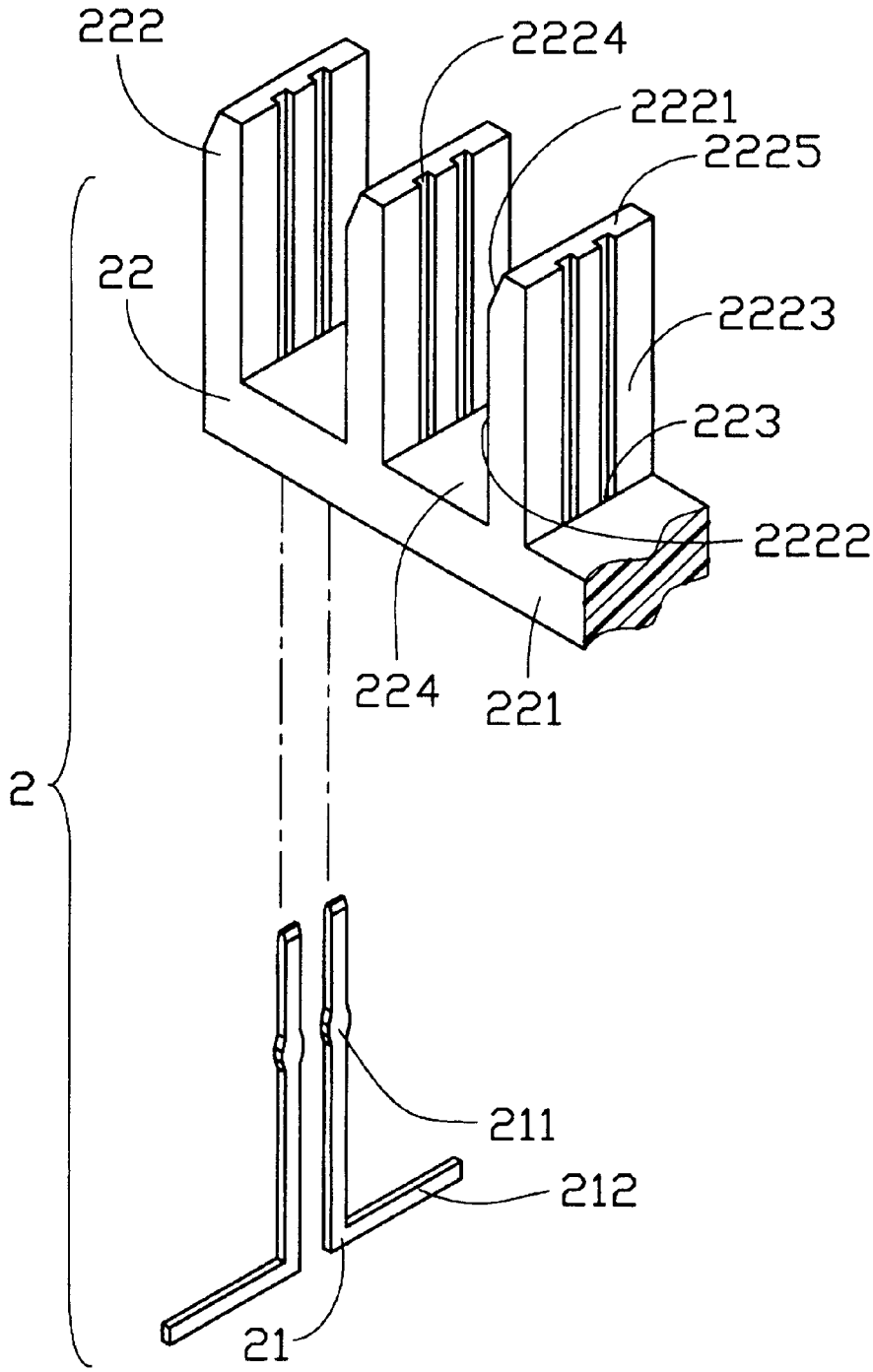
FIG. 1 is an exploded perspective view of a first electrical connector of an electrical connector assembly in accordance with the present invention.
Figure 2:
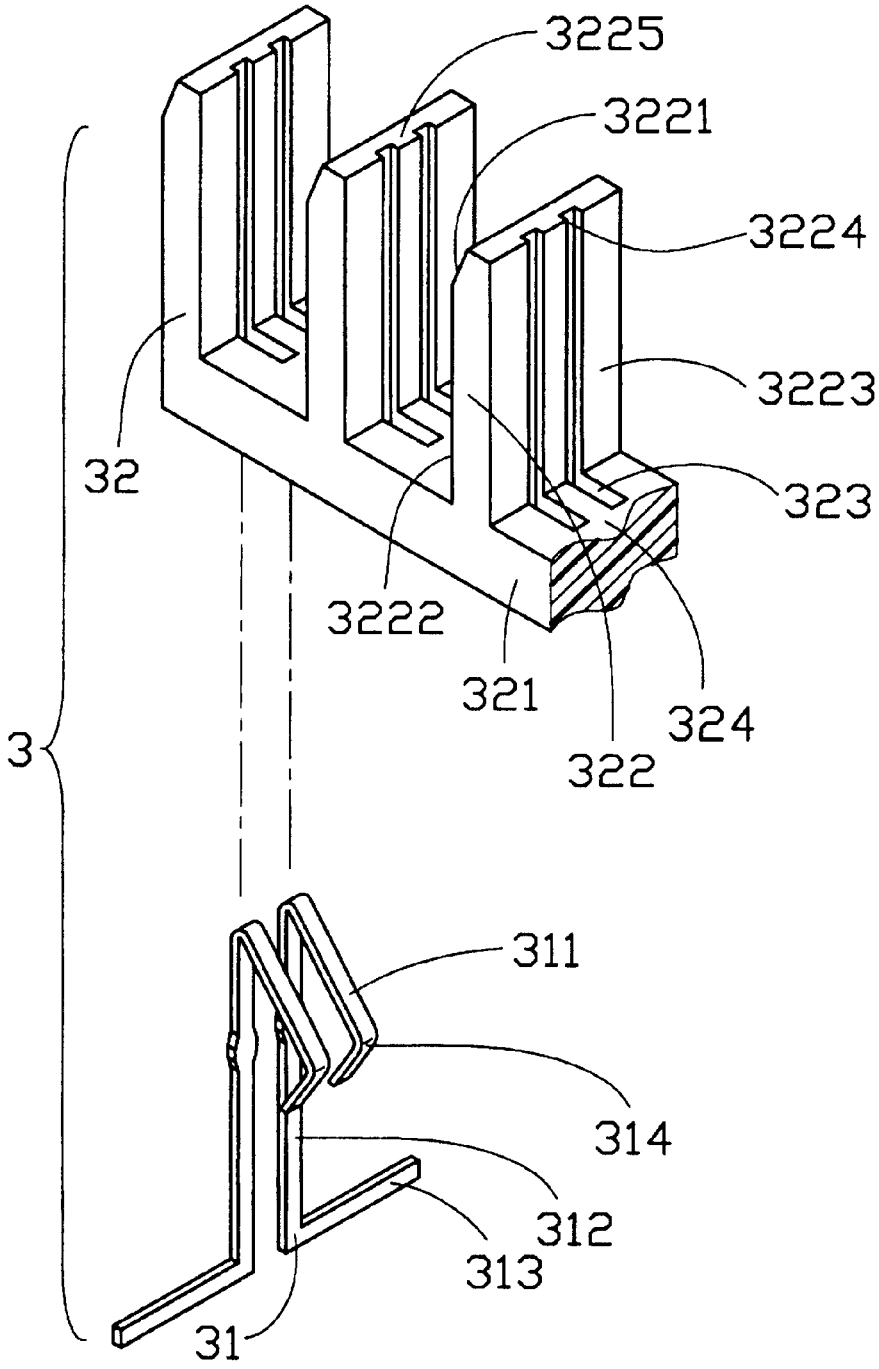
FIG. 2 is an exploded perspective view of a second electrical connector of the electrical connector assembly.

Referring to FIGS. 1 and 2, an electrical connector assembly in accordance with the present invention comprises a first electrical connector 2 and a second electrical connector 3.

The first electrical connector 2 comprises an insulative housing 22 and a plurality of electrical contacts 21. The insulative housing 22 comprises a base portion 221 and a plurality of tongues 222 extending upwardly from a top face 224 of the base portion 221. The base portion 221 defines a plurality of passageways 223 extending vertically therethrough. The tongues 222 extend along a lateral direction of the base portion 221 and are spaced from each other along a longitudinal direction of the base portion 221. Each tongue 222 comprises a top face 2225, a guiding face 2222 and a mating face 2223 opposite to the guiding face 2222. The guiding face 2222 comprises an inclined lead-in section 2221 adjacent to the top face 2225. The mating face 2223 defines a pair of vertically extending channels 2224 and each channel 2224 is in communication with a corresponding passageway 223 of the base portion 221.

The electrical contacts 21 are generally L-shaped and each comprises a contact portion 211 and a mounting portion 212 extending perpendicularly from the contact portion 211.

The second-electrical connector 3 comprises an insulative housing 32 and a plurality of electrical contacts 31. The insulative housing 32 is generally similar to the insulative housing 22 and comprises a base portion 321 and a plurality of tongues 322 extending upwardly from a top face 324 of the base portion 321. The base portion 321 comprises a plurality of passageways 323 extending vertically therethrough. The tongues 322 each extend along a lateral direction of the base portion 321 and are spaced from each other along a longitudinal direction of the base portion 321. Each tongue 322 comprises a guiding face 3222, a mating face 3223 opposite to the guiding face 3222 and a top face 3225. The guiding face 3222 comprises an inclined lead-in section 3221 adjacent to the top face 3225. The mating face 3223 defines a pair of vertically extending channels 3224 therein and each channel 3224 is in communication with a corresponding passageway 323 of the base portion 321.

Each of the electrical contacts 31 comprises a mounting portion 313, a retention portion 312 extending perpendicularly from the mounting portion 313 and a contact portion 311. The contact portion 311 extends downwardly from an upper end of the retention portion 312 to be located beside one side of the retention portion 311 and to provide resilience to the electrical contact 31 in mating. The contact portion 311 comprises a curved section 314 protruding outwardly adjacent to a free end thereof.

In assembly, the contact portions 211 of the electrical contacts 21 are inserted through the passageways 223 of the base portion 221 into the channels 2224 of the tongues 222 to be retained to and exposed on the tongues 222. The mounting portions 212 extend beyond the insulative housing 22 to be electrically connected with and mechanically mounted to a first printed circuit board (not shown). The longitudinal direction of the base portion 221 of the first electrical connector 2 is, as known to the persons skilled in the pertinent art, parallel to the first printed circuit board.

The retention and the contact portions 312, 311 of the electrical contacts 31 are inserted; through the passageways 323 of the base portion 321 into the channels 3224 of the tongues 322 to retain the retention portions 312 in the channels 3224. The curved portions 314 of the electrical contacts 31 protrude beyond the mating faces 3223 of the mating plates 322 to be located in spaces between the adjacent tongues 322. The mounting portions 313 extend beyond the insulative housing 32 for being mechanically mounted and electrically connected to a second printed circuit board (not shown). The longitudinal direction of the base portion 321 is, as is known to persons of ordinary skill in the pertinent art, parallel to the second printed circuit board.

Figure 3:
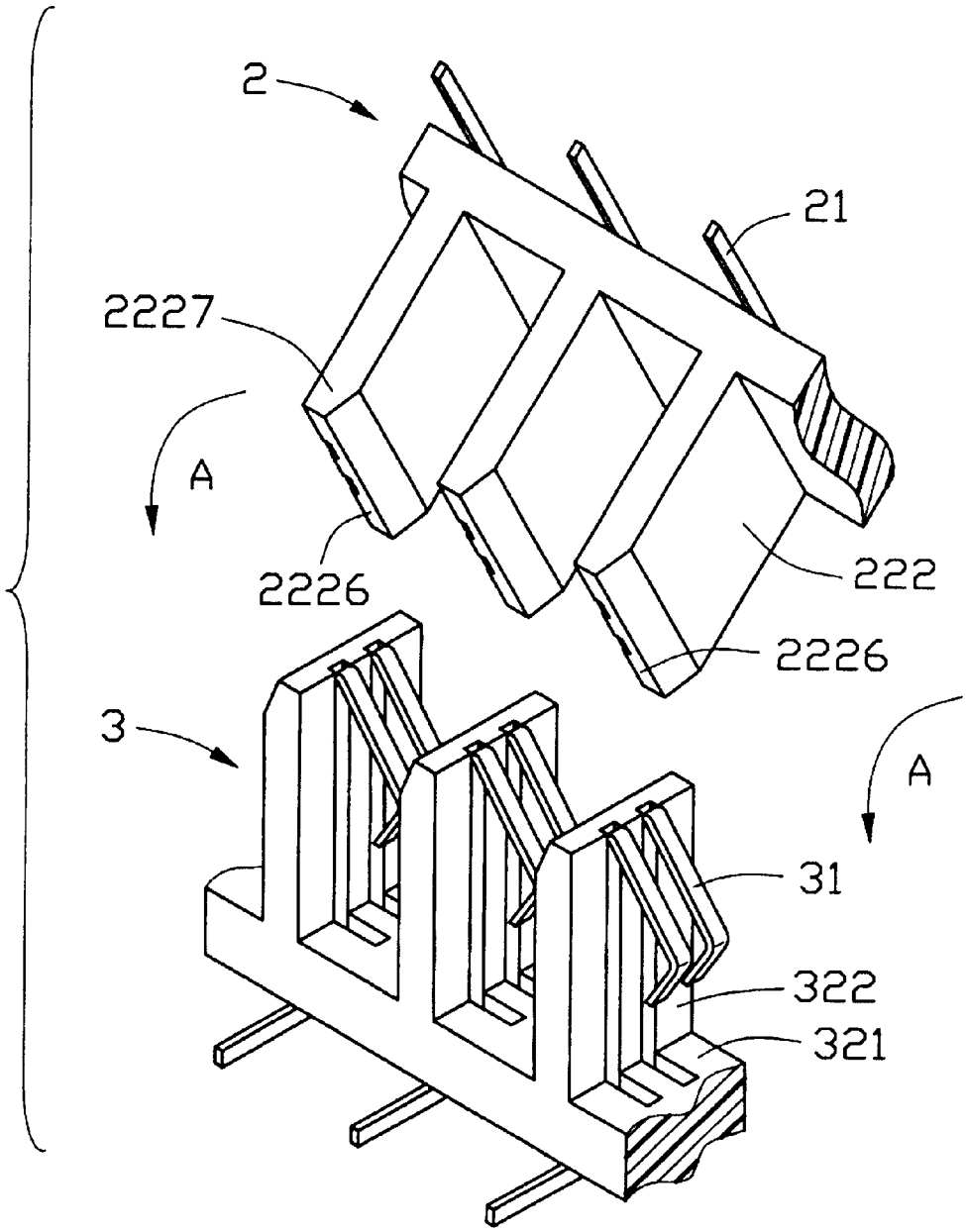
FIG. 3 is a perspective view of the electrical connector assembly before the first and the second electrical connectors thereof are completely mated.
Figure 3A:
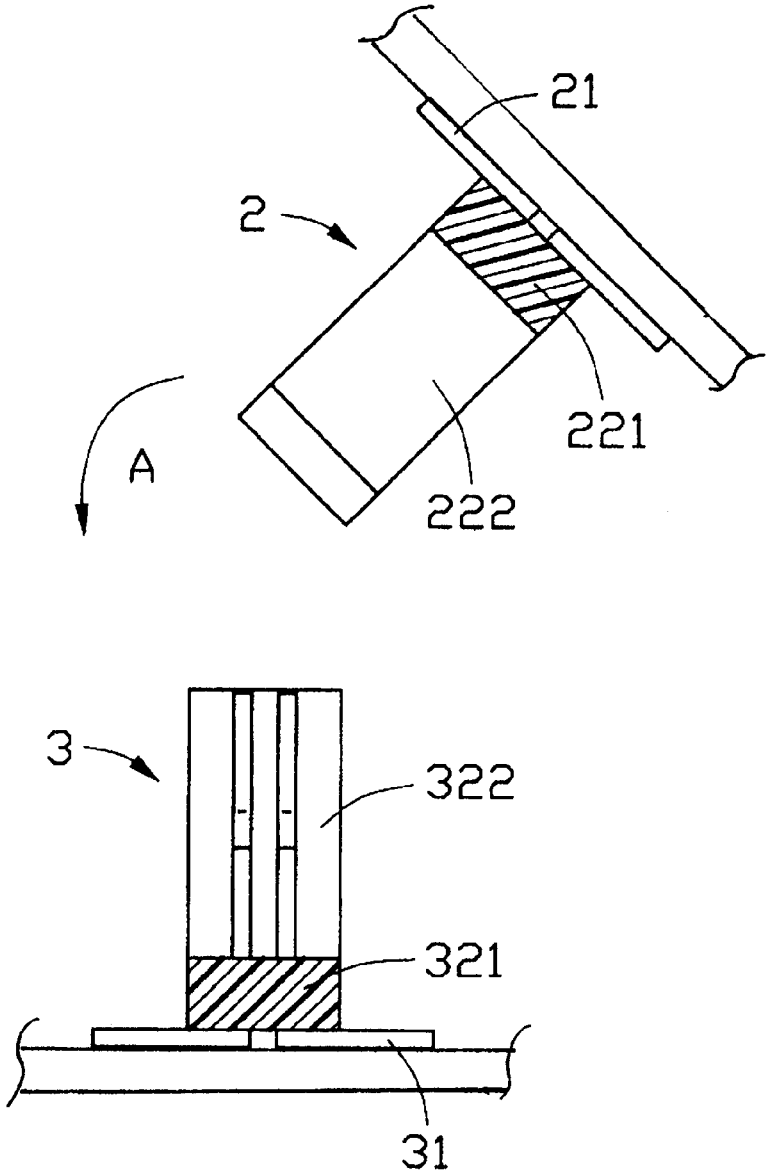
FIG. 3A is a cross-sectional view taken from FIG. 3.
Figure 4:
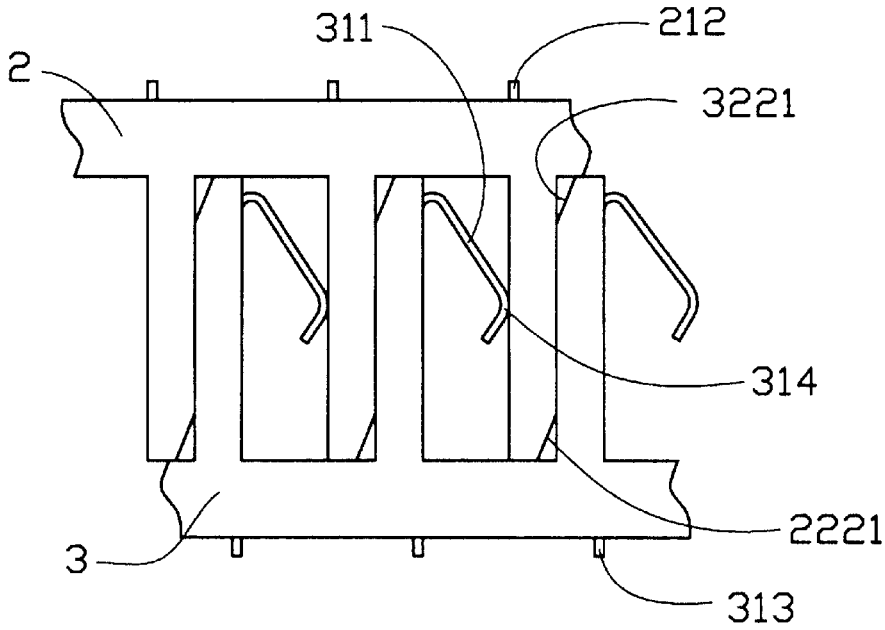
FIG. 4 is a front planar view of FIG. 3 but the first and the second electrical connectors have been completely mated with each other.

In use, when the first and the second printed circuit boards (not labeled) are to be electrically connected with each other, referring to FIGS. 3 and 3A, the lateral direction of the first electrical connector 2 defines an angle with respect to the lateral direction of the second electrical connector 3, wherein such an angle is deemed on an imaginary plane to which both first and second printed circuit boards are perpendicular, such that one top end 2226 of the tongue 222 of the first electrical connector 2 goes into between two adjacent tongues 322 of the second electrical connector 3 while the opposite top end 2227 of the tongue 222 is still above the top faces 3225 of the tongues 322. The first electrical connector 2 is then rotated in the direction as indicated by arrows A in FIGS. 3 and 3A so that the first and the second electrical connectors 2, 3 can completely mate with each other as shown in FIG. 4.

Since all of the tongues 222, 322: extend laterally on the base portions 221, 321 and are spaced from each other along the longitudinal directions of the base portions 221, 321, in the course of rotatably mating the first and the second electrical connectors 2, 3, there is no unwanted interferences between the insulative housings 22, 32, thereby the first and the second printed circuit boards can be rotatably connected to each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

first and second printed circuit boards facing to and angularly rotatably moved relative to each other;

a first electrical connector mounted on said first printed circuit board and comprising:

a first insulative housing comprising a first base portion defining a first longitudinal direction and a first lateral direction, and a plurality of first tongues extending from the first base portion, the first tongues extending parallely along the first lateral direction and being spaced from each other along the first longitudinal direction; and a plurality of first electrical contacts each comprising a mounting portion extending horizontally beyond the first base portion and a contact portion extending vertically from the mounting portion and exposed to the first tongue; and a second electrical connector mounted on said second printed circuit board communicatively facing to said first connector and comprising:

a second insulative housing comprising a second base portion defining a second lateral direction and a second longitudinal direction parallel to the first lateral and the first longitudinal directions, respectively, and a plurality of second tongues extending from the second base portion, the second tongues extending parallely along the second lateral direction between the first tongues and being spaced from each other along the second longitudinal direction to receive the first tongues; and a plurality of second electrical contacts each comprising a retention portion extending vertically, a mounting portion extending horizontally from the retention portion and beyond the second base portion, and a contact portion extending transversely from the retention portion through the second base portion and exposed to the second tongue to electrically contact with the contact portion of the first electrical contact; wherein each of the first and the second base portions defines a first top face and each of the first and the second tongues defines a second top face to abut against the first top face; wherein the first tongue defines a first guiding face comprising a first inclined lead-in section and the second tongue defines a second guiding face comprising a second inclined lead-in section complementary to the first inclined lead-in section; wherein each of first and the second base portions defines a plurality of passageways and each of the first and the second tongues comprises a mating face defining a plurality of channels in communication with the passageways, respectively, the contact portions of the first and the second electrical contacts extending through the passageways to be retained in the channels, respectively; wherein the contact portion of each of the second electrical contacts comprises a curved section protruding outwardly from the mating face of the second tongue to electrically contact against the contact portion of the first electrical contact.

2. The electrical connector assembly as claimed in claim 1, wherein the first and the second lateral directions of the first and the second base portions define an angle therebetween in the course of mating the first and the second electrical connectors.

* * * * *